US005775883A

United States Patent [19]

Hattori et al.

[11] Patent Number: 5,775,883

[45] Date of Patent: Jul. 7, 1998

[54] ROLLING-PISTON EXPANDER APPARATUS

[75] Inventors: Hitoshi Hattori; Masao Ozu; Kazuo Saito; Akira Morishima; Toshio Otaka; Motonori Futamura, all of Tokyo, Japan

[73] Assignee: Kabushiki Kaisha Toshiba, Kawasaki, Japan

[21] Appl. No.: 696,707

[22] Filed: Aug. 14, 1996

[51] Int. Cl.[6] ..... F04B 49/00; F01C 1/30

[52] U.S. Cl. ..... 417/310; 417/292; 417/293; 418/11

[58] Field of Search ..... 417/310, 292, 417/293; 418/11

[56] References Cited

U.S. PATENT DOCUMENTS 4,558,993 12/1985 Hori et al. ..... 417/310
4,859,159 8/1989 Aihara ..... 417/310
5,338,161 8/1994 Eley ..... 417/310

FOREIGN PATENT DOCUMENTS 63-9695 1/1988 Japan ..... 417/310
5312172 1/1993 Japan ..... 417/310

*Primary Examiner*—Bibhu Mohanty
*Attorney, Agent, or Firm*—Foley & Lardner

[57] ABSTRACT

A rolling-piston expander has a hermetic casing 7 provided with a suction pipe 3 and a discharge pipe 5, a cylinder 13 disposed in the casing, a roller 31 eccentrically rotated in the cylinder, an expansion chamber 39 defined by the roller and communicating with a suction port 47 and a discharge port 55, a shaft 19 for supporting the roller so that the roller may eccentrically rotate, a suction timing controller 51 consisting of the ports 47 and 51, for controlling the timing of the supply of gas into the expansion chamber, and a bypass for supplying high-pressure gas into the expansion chamber when the suction timing is off.

19 Claims, 22 Drawing Sheets

ROLLING-PISTON EXPANDER APPARATUS

BACKGROUND OF THE INVENTION

1. Field of the Invention

The present invention relates to a rolling-piston expander apparatus that is compact, light, and able to start without a starting motor.

2. Description of the Prior Art

A conventional rolling-piston expander has a cylinder having a suction port and a discharge port. To start the expander, a starting motor drives a shaft of the cylinder. The shaft consists of a main shaft and a countershaft supported by bearings.

The cylinder incorporates a roller coupled with an eccentric shaft (a crank) that is integral with the main shaft and countershaft.

The roller is eccentrically rotated to draw high-pressure gas through the suction port and carry out suction, expansion, and discharge strokes. The gas is repeatedly drawn and discharged through the expander.

This expander achieves Rankine cycles. When the expander is stopped, the suction port is closed by a suction timing controller, to stop the supply of high-pressure gas thereto. Accordingly, the expander must have the starting motor that supplies high-pressure gas into an expansion chamber at the start of the expander. The starting motor increases the size of the expander, complicates the structure thereof, necessitates additional assembling work, and raises costs.

SUMMARY OF THE INVENTION

An object of the present invention is to provide a rolling-piston expander apparatus that is compact, light, and able to start without a starting motor.

In order to accomplish the object, the present invention provides a rolling-piston expander apparatus having a hermetic casing provided with a suction pipe and a discharge pipe, a cylinder disposed in the casing, a shaft eccentrically rotated, a roller supported by said shaft in said cylinder so that said roller is oscillated and defining an expansion chamber communicating with a suction port and discharge port, a suction timing controller for controlling the timing of the supply of gas into the expansion chamber, and a gas supply system for supplying high-pressure gas into the expansion chamber when the suction timing is off.

The present invention also provides a rolling-piston expander apparatus having a hermetic casing provided with a suction pipe and a discharge pipe, cylinders disposed in the casing, a shaft eccentrically rotated, rollers supported by said shaft in said cylinder so that said rollers are oscillated and defining an expansion chamber communicating with a suction port and discharge port, a suction timing controller for controlling the timing of the supply of gas into the expansion chambers, and a gas supply system for supplying high-pressure gas into one of the expansion chambers when the suction timing is off.

If the apparatus has two cylinders, the gas supply system involves apertures for the expansion chambers, the apertures being shifted from each other by at least 180 degrees. If there are three cylinders, the apertures may be shifted from one another by at least 120 degrees.

Alternatively, the gas supply system involves bypasses for guiding high-pressure gas into one of the expansion chambers when the suction timing is off.

The bypasses may be formed along the peripheries of eccentric parts (cranks) of the shaft for eccentrically driving the rollers, or along the inner walls of the rollers, or along the periphery of the shaft, or along the peripheries of bearings that rotatably support the shaft.

The apparatus may have a unit for opening and closing the bypasses in response to a signal from a detector that detects the operation of the expander.

Each roller is eccentrically rotated to draw high-pressure gas through the suction port and carry out suction, expansion, and discharge strokes. The gas is repeatedly drawn and discharged through the apparatus.

When the apparatus having two cylinders is stopped, the suction timing controller may close the suction ports. At this time, one of the expansion chambers secures a path for receiving high-pressure gas because the apertures for the expansion chambers are shifted from each other by at least 180 degrees.

When the angular difference between the apertures is less than 180 degrees, or when the apparatus has a single cylinder, high-pressure gas is supplied into the expansion chamber through the bypass at the start of the expander. Thereafter, the suction, expansion, and discharge strokes are repeated. Once the operation of the apparatus is stabilized, the opening/closing unit closes the bypass.

The detector that provides the opening/closing unit with a shutoff signal may operate in response to a signal from a temperature sensor for detecting the temperature of working gas, a pressure sensor for detecting the pressure of working gas, a sensor for detecting the rotation speed of the apparatus, or a pressure sensor for detecting the pressure of working gas in an expander or a compressor.

The opening/closing unit may be a spring made of a shape-memory alloy whose shape changes depending on the temperature of working gas.

These and other objects, features, and advantages of the present invention will be more apparent from the following detailed description of preferred embodiments in conjunction with the accompanying drawings.

DETAILED DESCRIPTION OF THE EMBODIMENTS

The embodiments of the present invention will be explained with reference to the drawings.

(First embodiment)

Figure 1:
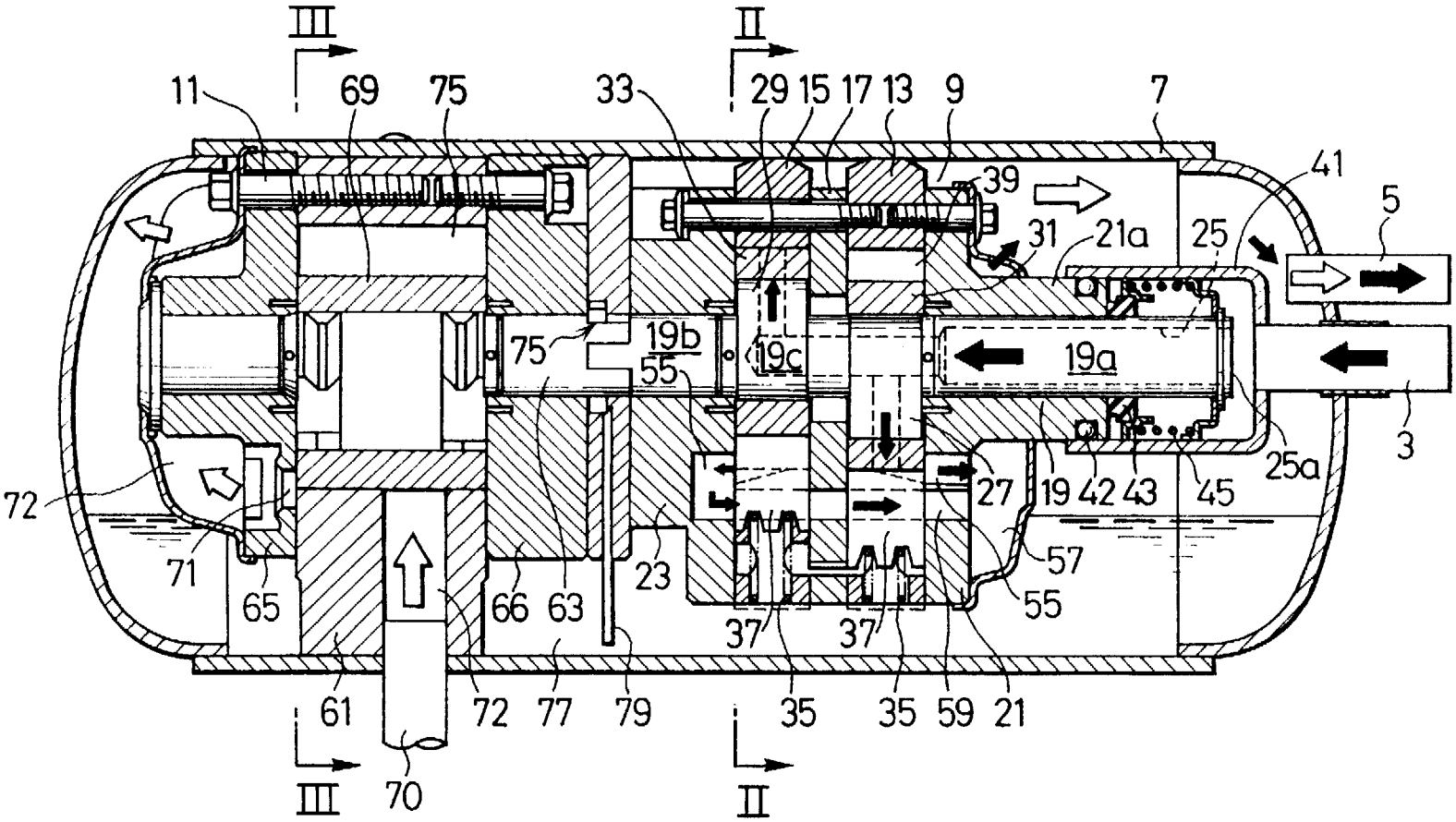
FIG. 1 is a longitudinal section showing a rolling-piston expander apparatus according to a first embodiment of the present invention.

FIG. 1 is a longitudinal section showing a rolling-piston expander apparatus 100 according to the first embodiment of the present invention.

The apparatus 100 has a hermetic casing 7 having a suction pipe 3 and a discharge pipe 5. The casing 7 accommodates an expander 9 at the right and a compressor 11 at the left. The expander 9 achieves a Rankine cycle and the compressor 11 a refrigerating cycle with the same working gas.

(Expander)

The expander 9 will be explained.

The expander 9 has first and second cylinders 13 and 15 that are directly supported by the inner wall of the casing 7 and are separated from each other by a partition 17. A shaft 19 passes through the cylinders 13 and 15.

The shaft 19 consists of a main shaft 19*a*, a countershaft 19*b*, and eccentric shafts 19*c*. The shaft 19 is rotatably supported by a main-shaft bearing 21 and a countershaft bearing 23. The shaft 19 has a suction path 25. The eccentric shafts 19*c* form cranks 27 and 29, which are in the first and second cylinders 13 and 15, respectively, and are shifted from each other by 180 degrees. The cylinders 13 and 15 have first and second rollers 31 and 33 that engage with the cranks 27 and 29, respectively. The rollers 31 and 33 are oscillated by the cranks 27 and 29 with a phase shift of 180 degrees between them.

The periphery of each of the rollers 31 and 33 is always in contact with a blade 37 that is pushed by a spring 35 or by back pressure. The blade 37 and roller 31 (33) define an expansion chamber 39.

The suction path 25 in the shaft 19 extends from an end of the shaft 19 up to the cranks 27 and 29 along the center axis of the shaft 19. The suction path 25 has a suction port 25*a*, which communicates with the suction pipe 3 through a casing 41. The casing 41 is attached to a part 21*a* of the bearing 21. An O-ring 42 seals a space between the casing 41 and the part 21*a*. An annular seal 43 is pushed by a spring 45 to seal a space between the bearing 21 and the main shaft 19*a*. These arrangements prevent a leak of high-pressure gas.

Figure 4:
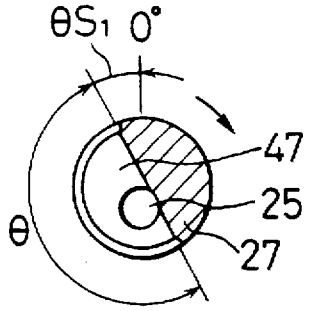
FIG. 4 shows a suction port of a first cylinder of the apparatus of FIG. 1.
Figure 5:
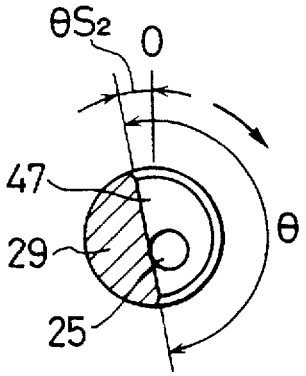
FIG. 5 shows a suction port of a second cylinder of the apparatus of FIG. 1.

FIG. 4 shows a suction port 47 of the first cylinder 13, and FIG. 5 shows a suction port 47 of the second cylinder 15.

The suction port 47 of the first cylinder 13 is formed along the periphery of the crank 27, and the suction port 47 of the second cylinder 15 is formed along the periphery of the crank 29. The suction ports 47 are shifted from each other by 180 degrees and communicate with ports 49 of the rollers 31 and 33, and the ports 49 communicate with the expansion chambers 39.

Figure 2:
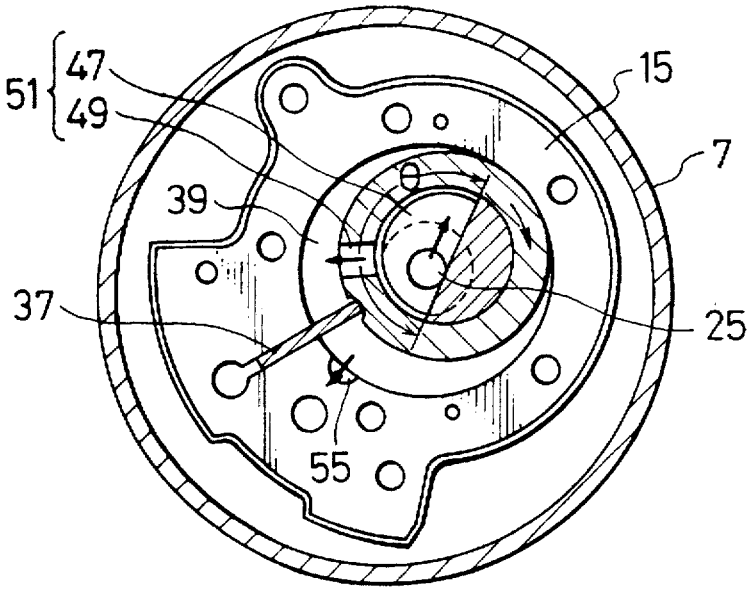
FIG. 2 is a section taken along a line A—A of FIG. 1.
Figure 3:
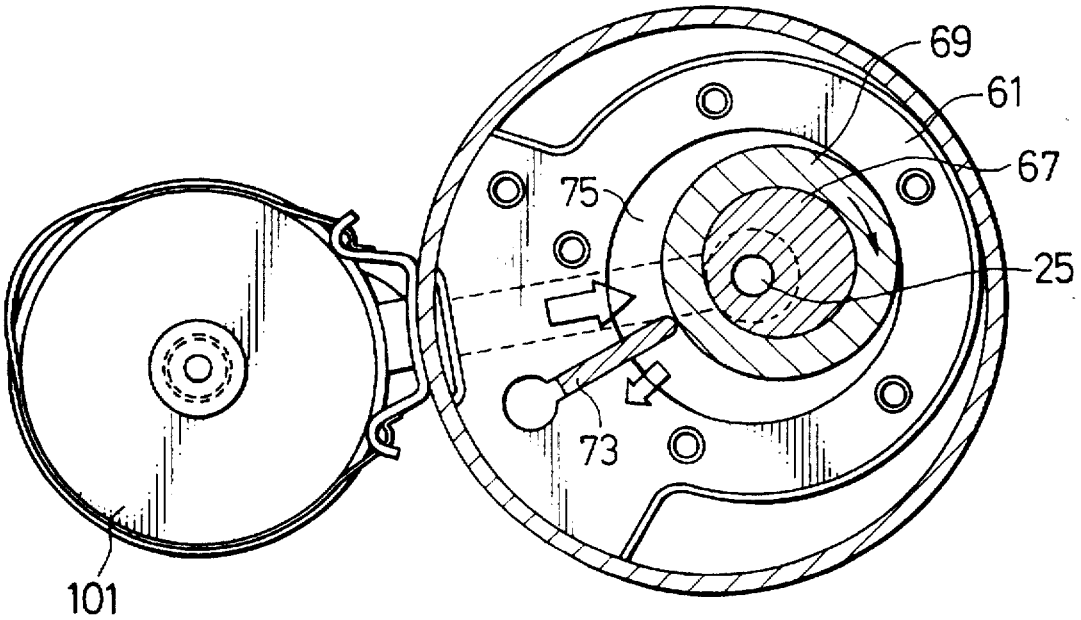
FIG. 3 is a section taken along a line B—B of FIG. 1.

FIG. 2 is a section taken along a line A—A of FIG. 1, and FIG. 3 is a section taken along a line B—B of FIG. 1.

Each pair of the ports 47 and 49 forms a suction timing controller 51 to supply high-pressure gas into the corresponding expansion chamber 39. Namely, the ports 47 and 49 communicate with each other whenever a corresponding one of the cranks 27 and 29 is turned by about 180 degrees, to feed high-pressure gas into the expansion chamber 39.

Each of the suction ports 47 has an aperture angle of 180 degrees as shown in FIGS. 4 and 5, so that one of the ports 47 may communicate with the corresponding port 49 when the apparatus 100 is stopped.

Figure 6:
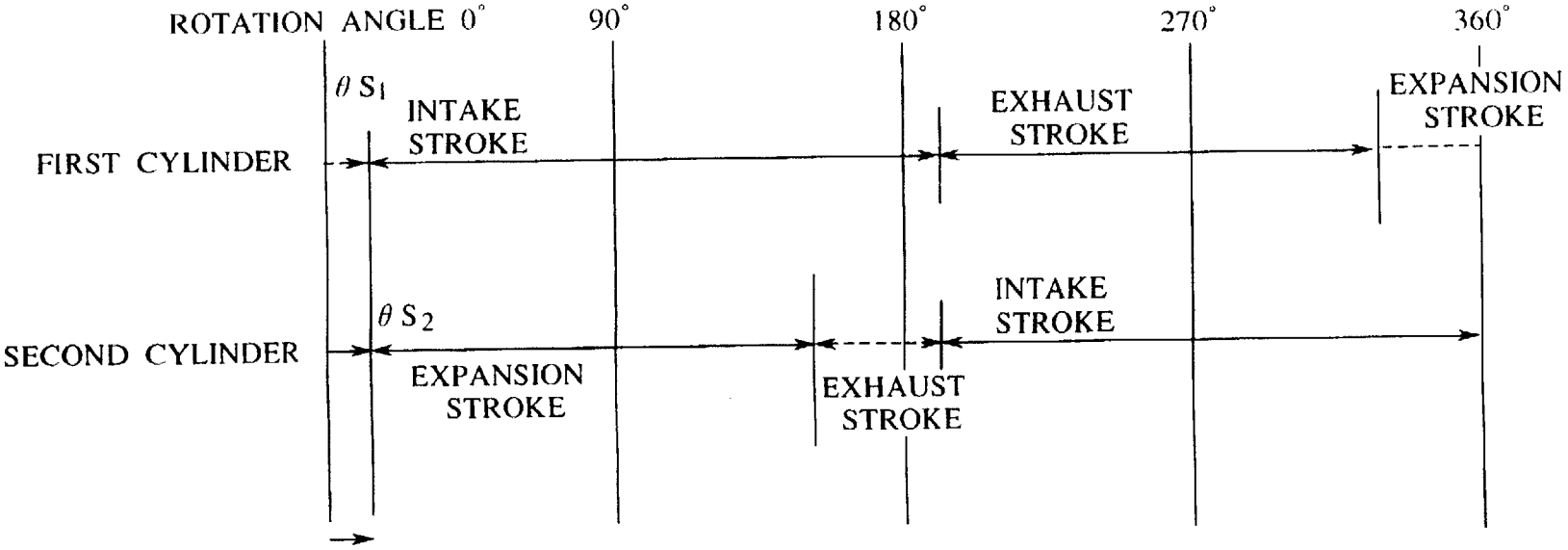
FIG. 6 shows the rotation angles and suction timing of the apparatus of FIG. 1.

FIG. 6 shows the rotation angles of the shaft 19 and the timing of drawing gas in the apparatus 100. Irrespective of the angular positions of the suction ports 47, one of the ports 47 communicates with the corresponding port 49 when the apparatus 100 is stopped.

The first cylinder 13 has a discharge port 55 opening to the bearing 21, and the second cylinder 15 has a discharge port 55 opening to the bearing 23.

More precisely, the discharge port 55 of the first cylinder 13 is open to a muffler chamber 57, which communicates with the discharge pipe 5 of the casing 7. The discharge port 55 of the second cylinder 15 is open to the muffler chamber 57 through a through hole 5*a*, which passes through the second cylinder 15, partition 17, and first cylinder 13. The muffler chamber 57 is open inside the casing 7 having the discharge pipe 5.

(Compressor)

The compressor 11 of the apparatus 100 will be explained.

The compressor 11 has a single cylinder 61 that is directly supported by the inner wall of the casing 7. The cylinder 61 has a shaft 63.

The shaft 63 is integral with the shaft 19 of the expander 9 and is rotatably supported by bearings 65 and 66. The cylinder 61 has a roller 69 that is engaged with an eccentric part (crank) 67 of the shaft 63. The roller 69 is eccentrically rotated by the crank 67.

The bearing 65 has a discharge port 71 having a shutoff valve. The discharge port 71 is open to a muffler chamber 72 that is open inside the casing 7, which has the discharge pipe 5.

The cylinder 61 has a suction port connected to a suction pipe 70. The cylinder also has a blade 73 that is pushed by a spring or back pressure to always be in contact with the periphery of the roller 69. The roller 69 and blade 73 define a compression chamber 75.

An eccentric rotary pump for lubrication is arranged between the bearing 66 of the compressor 11 and the bearing 23 of the expander 9. A suction port of the rotary pump is connected to a lubricant pipe 79, which extends into a sump 77 for storing lubricant. A discharge port of the rotary pump is connected to piping (not shown) that supplies lubricant to the rollers 31, 33, and 69.

(System of cycles)

Figure 7:
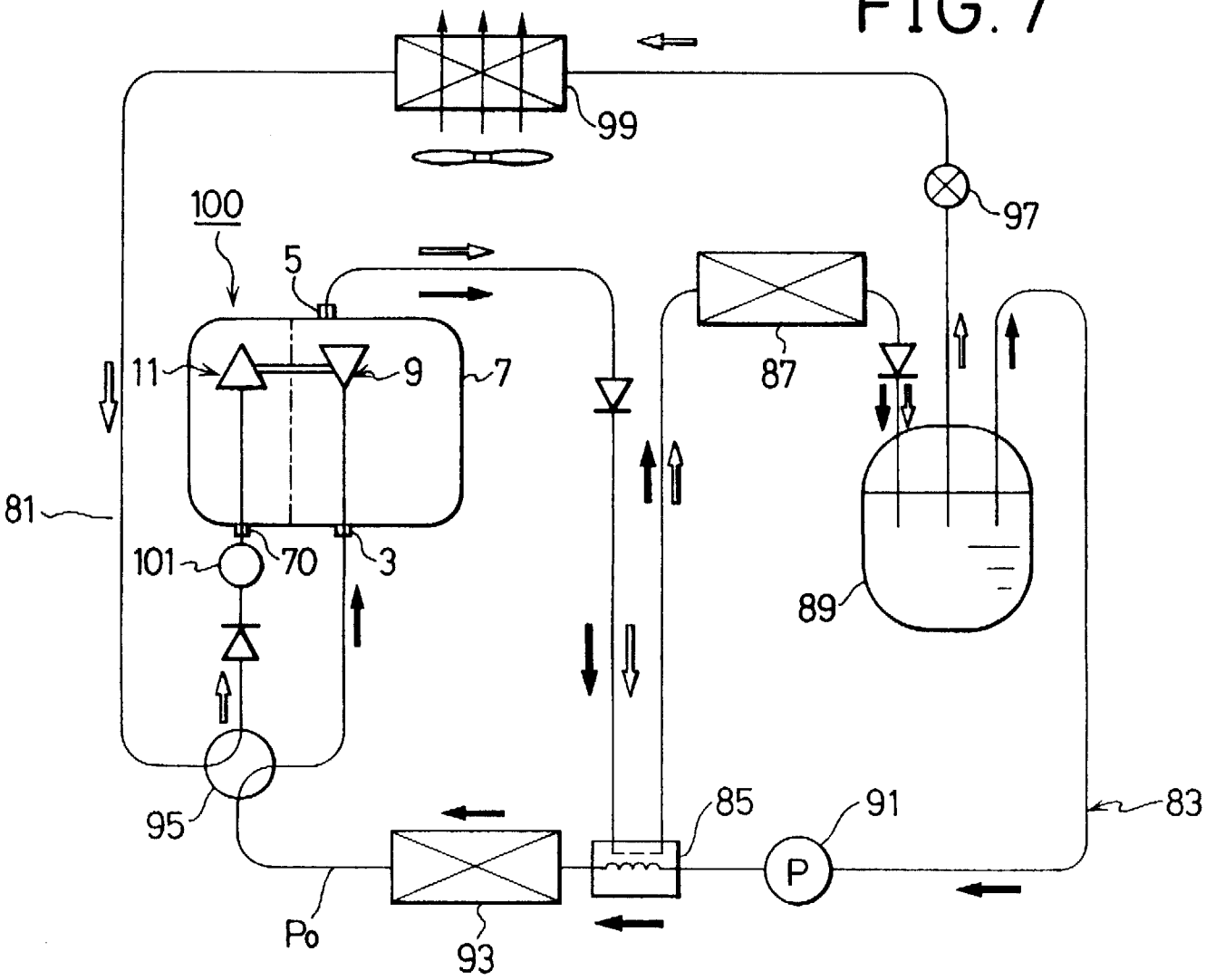
FIG. 7 shows a system of cycles of the apparatus of FIG. 1.

FIG. 7 shows a system of cycles carried out by the apparatus 100. The hermetic casing 7 accommodates the compressor 11 and expander 9. The compressor 11 achieves a refrigerating cycle 81, and the expander 9 achieves a Rankine cycle 83.

In the Rankine cycle, the discharge pipe 5 of the casing 7 discharges working gas, which is passed through a heat recovery unit 85, a heat exchanger 87 such as a condenser, a liquid tank 89, a high-pressure pump 91, a heat recovery unit 85, an evaporator 93 with a heater, and a four-way valve 95 and is returned to the suction pipe 3 of the expander 9. The working gas is pressurized by the high-pressure pump 91, is heated through the heat recovery unit 85 and evaporator 93, and is fed into the suction pipe 3 of the expander 9.

In the refrigerating cycle 81, the discharge pipe 5 of the casing 7 discharges working gas, which is passed through the heat recovery unit 85, the heat exchanger 87, the liquid tank 89, an expansion valve 97, a heat exchanger 99 such as an evaporator, the four-way valve 95, and an accumulator 101 and is returned to the suction pipe 70 of the compressor 11. The heat exchanger 99 cools air when the air passes through it.

The rollers 31 and 33 of the expander 9 are oscillated to draw high-pressure gas through the suction ports 47 and carry out suction, expansion, and discharge strokes. The gas is repeatedly drawn and discharged through the expander 9. This operation provides the shaft 19 with torque to drive the shaft 63 of the compressor 11. As a result, the roller 69 of the compressor 11 is eccentrically rotated to achieve the refrigerating cycle that draws working gas from the suction pipe 70, discharges it from the discharge pipe 5, and returns the gas to the suction pipe 70.

When the apparatus 100 is stopped, one of the suction ports 47 is communicating with the corresponding expansion chamber 39 irrespective of the stopped position. This is because the aperture angles of the suction ports 47 are shifted from each other by 180 degrees. As soon as the apparatus 100 is started, high-pressure gas is fed into one of the expansion chambers 39 without a starting motor, to carry out the suction, expansion, and discharge strokes.

(Second embodiment)

Figure 8:
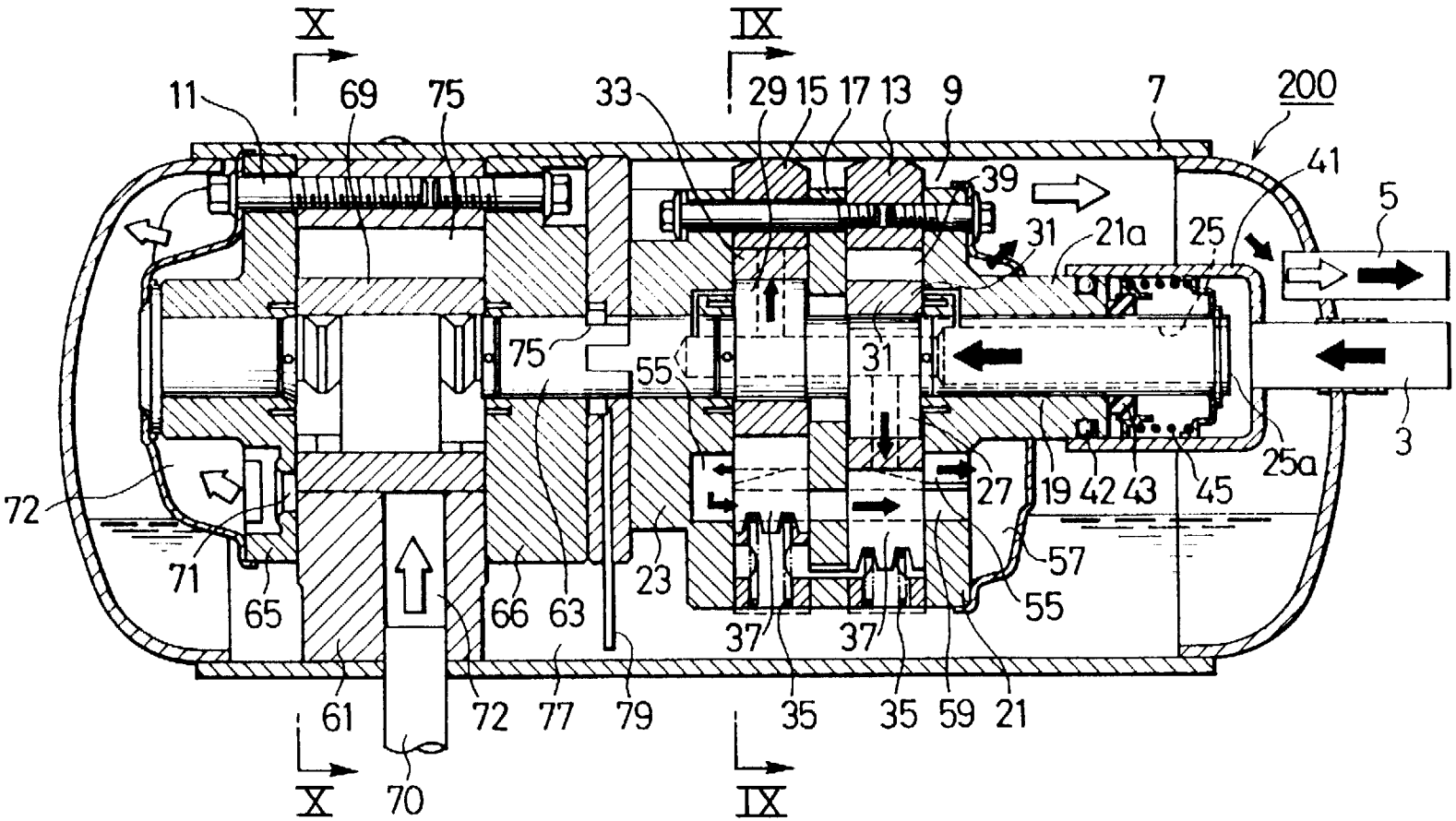
FIG. 8 is a longitudinal section showing a rolling-piston expander apparatus according to a second embodiment of the present invention.

FIG. 8 is a longitudinal section showing a rolling-piston expander apparatus 200 according to the second embodiment of the present invention.

This embodiment employs means for connecting a suction port 47 with an expansion chamber 39 when the suction port 47 is closed.

The same parts as those of the first embodiment are represented with like reference marks.

The apparatus 200 has a hermetic casing 7 having a suction pipe 3 and a discharge pipe 5. The casing 7 accommodates an expander 9 at the right and a compressor 11 at the left. The expander 9 achieves a Rankine cycle and the compressor 11 a refrigerating cycle with the same working gas.

The expander 9 has first and second cylinders 13 and 15 that are directly supported by the inner wall of the casing 7 and are separated from each other by a partition 17. A shaft 19 passes through the cylinders 13 and 15.

The shaft 19 is rotatably supported by bearings 21 and 23. The shaft 19 has a suction path 25. The shaft 19 has cranks 27 and 29 that are in the first and second cylinders 13 and 15, respectively, and are shifted from each other by 180 degrees. The cylinders 13 and 15 have first and second rollers 31 and 33 that engage with the cranks 27 and 29, respectively. The rollers 31 and 33 are oscillated by the cranks 27 and 29 with a phase shift of 180 degrees between them.

The periphery of each of the rollers 31 and 33 is always in contact with a blade 37 that is pushed by a spring 35 or by back pressure. The blade 37 and roller 31 (33) define an expansion chamber 39.

The suction path 25 in the shaft 19 extends from an end of the shaft 19 up to the cranks 27 and 29 along the center axis of the shaft 19. The suction path 25 has a suction port **25*a*, which communicates with the suction pipe 3 through a casing 41. The casing 41 is attached to a part 21*a* of the bearing 21. An O-ring 42 seals a space between the casing 41 and the part 21*a*. An annular seal 43 is pushed by a spring 45 to seal a space between the bearing 21 and the shaft 19**. These arrangements prevent a leak of high-pressure gas.

Figure 9:
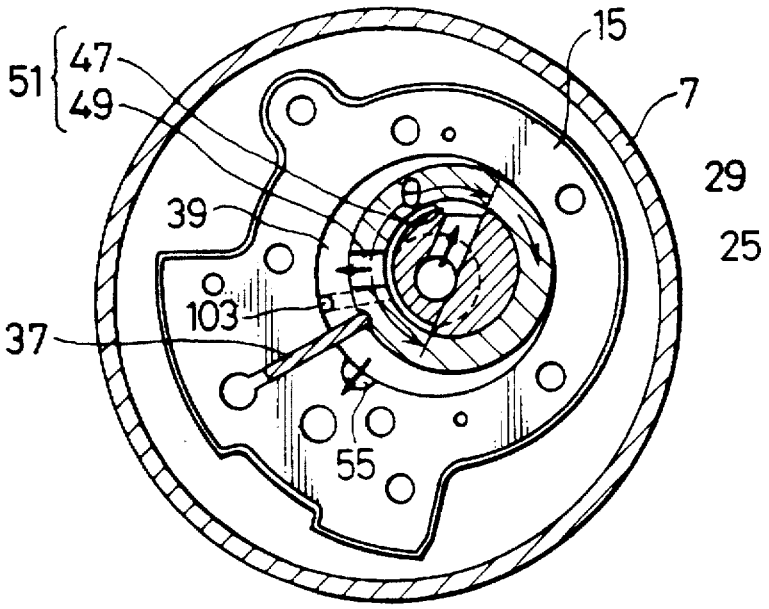
FIG. 9 is a section taken along a line C—C of FIG. 8.
Figure 10:
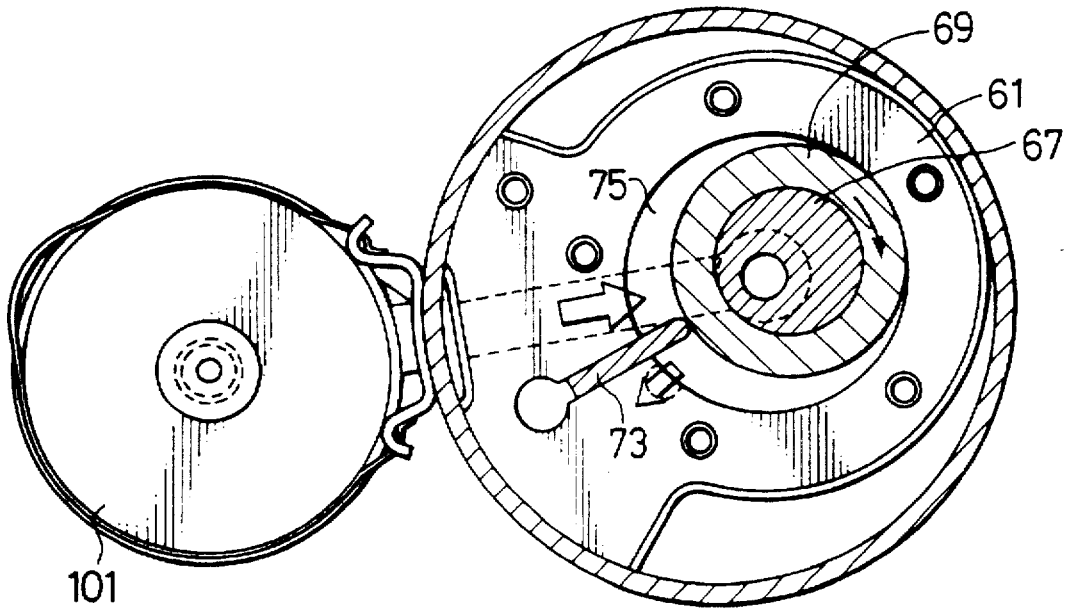
FIG. 10 is a section taken along a line D—D of FIG. 8.

FIG. 9 is a section taken along a line C—C of FIG. 8, and FIG. 10 is a section taken along a line D—D of FIG. 8.

The suction ports 47 are formed along the peripheries of the cranks 27 and 29, respectively. The suction ports 47 are shifted from each other by 180 degrees and communicate with ports 49 of the rollers 31 and 33, and the ports 49 communicate with the expansion chambers 39.

Each pair of the ports 47 and 49 forms a suction timing controller 51 to supply high-pressure gas into the corresponding expansion chamber 39 when the ports 47 and 49 face each other.

(Bypass 103)

The bearings 21 and 23 have each the bypass 103. An end of the bypass 103 is connected to the expansion chamber 39, and the other end thereof to the suction path 25.

When the apparatus 200 is stopped, the suction ports 47 may be closed with respect to the ports 49. At this time, the bypasses 103 secure communication between the expansion chambers 39 and the suction paths 25 irrespective of the stopping positions of the suction ports 47.

(Bypasses 105 on cranks 27 and 29)

Figure 11:
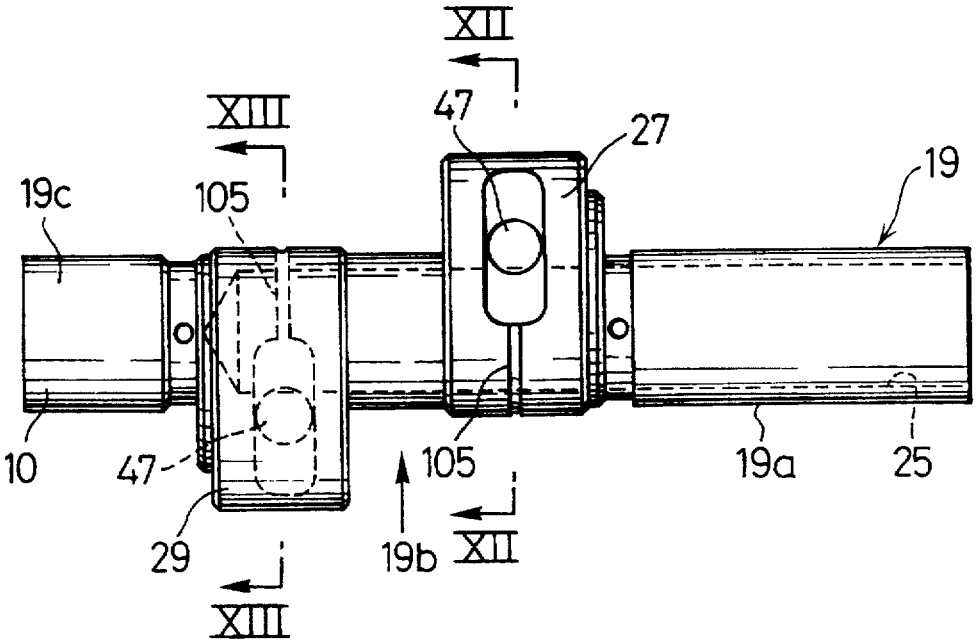
FIG. 11 is a plan view showing a shaft of an expander of the apparatus of FIG. 8 with a bypass being formed along the periphery of each eccentric part (crank) of the shaft.
Figure 12:
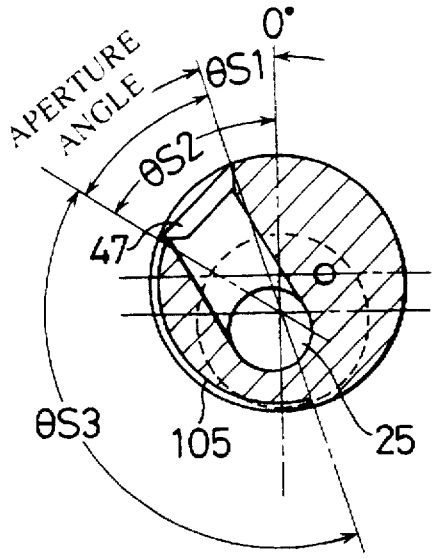
FIG. 12 is a section taken along a line E—E of FIG. 11.

FIG. 11 is a plan view showing eccentric parts (cranks) 27 and 29 of a shaft 19 that may be installed in the apparatus 200 of FIG. 8. FIG. 12 is a section taken along a line E—E of FIG. 11, and FIG. 13 is a section taken along a line F—F of FIG. 11.

A bypass 105 is formed along the periphery of each of the cranks 27 and 29. The cranks are installed in the first and second cylinders 13 and 15 of the expander 9, respectively.

In FIG. 12, the suction port 47 of the crank 27 starts from an angle position of θ S1 with a center axis being at zero degrees. The bypass 105 starts from a distal end of the suction port 47 and extends for an angle of θ S3, so that a suction area including the suction port 47 and bypass 105 ranges for about 180 degrees.

Figure 13:
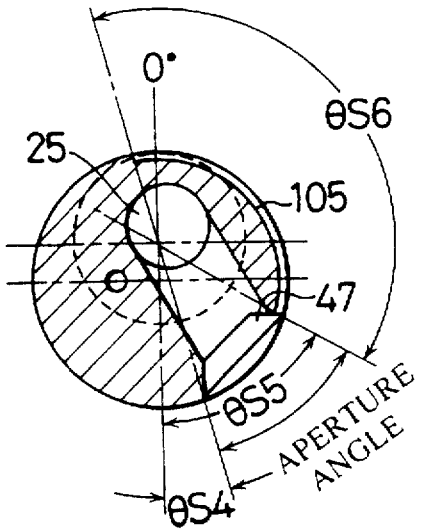
FIG. 13 is a section taken along a line F—F of FIG. 11.
Figure 23:
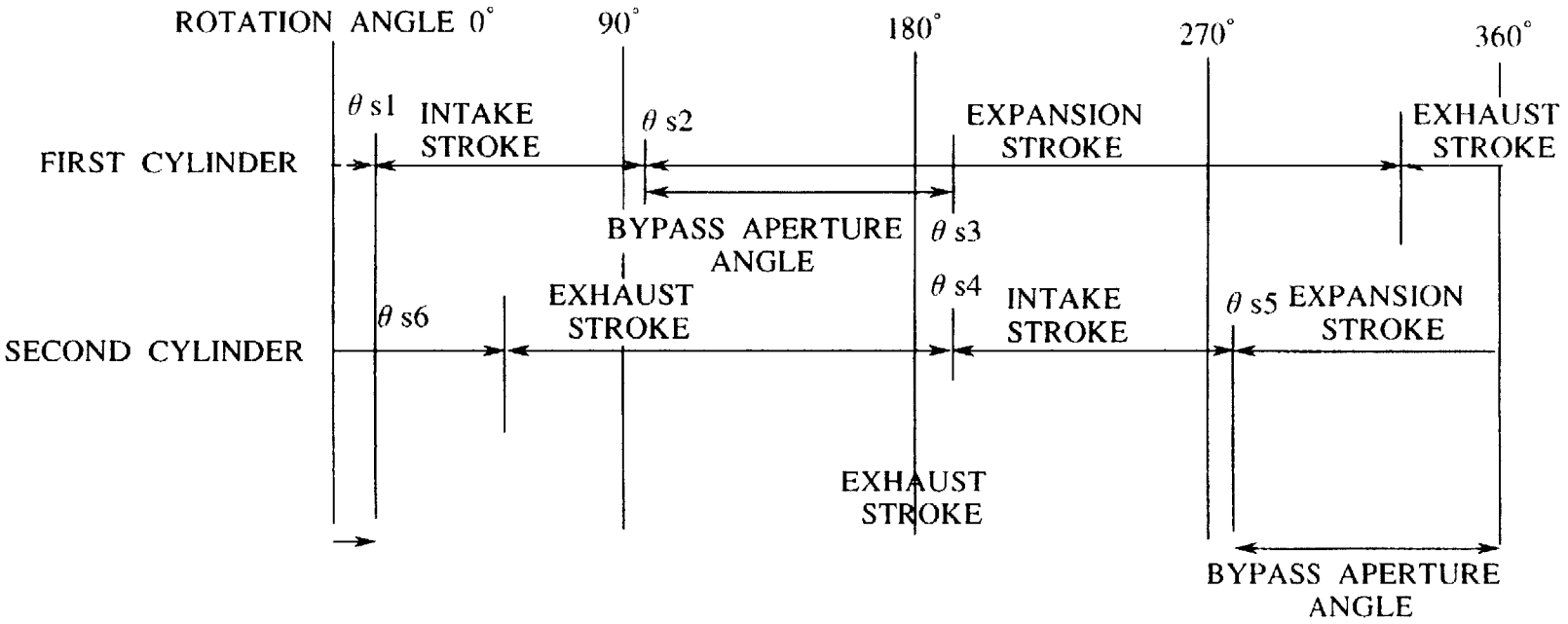
FIG. 23 shows the rotation angles and bypass opening timing of the expander of FIG. 8.

In FIG. 13, the suction port 47 of the crank 29 starts from an angle position of θ S4 with a center axis being at zero degrees. The bypass 105 starts from a distal end of the suction port 47 and extends for an angle of θ S6, so that a suction area including the suction port 47 and bypass 105 ranges for about 180 degrees. The bypasses 105 of the cranks 27 and 29 are shifted from each other by 180 degrees. The bypasses 105 let one of the expansion chambers 39 communicate with the suction path 25 to draw high-pressure gas irrespective of the stopping angles of the suction ports 47, as shown in FIG. 23.

(Bypasses on rollers)

Figure 14:
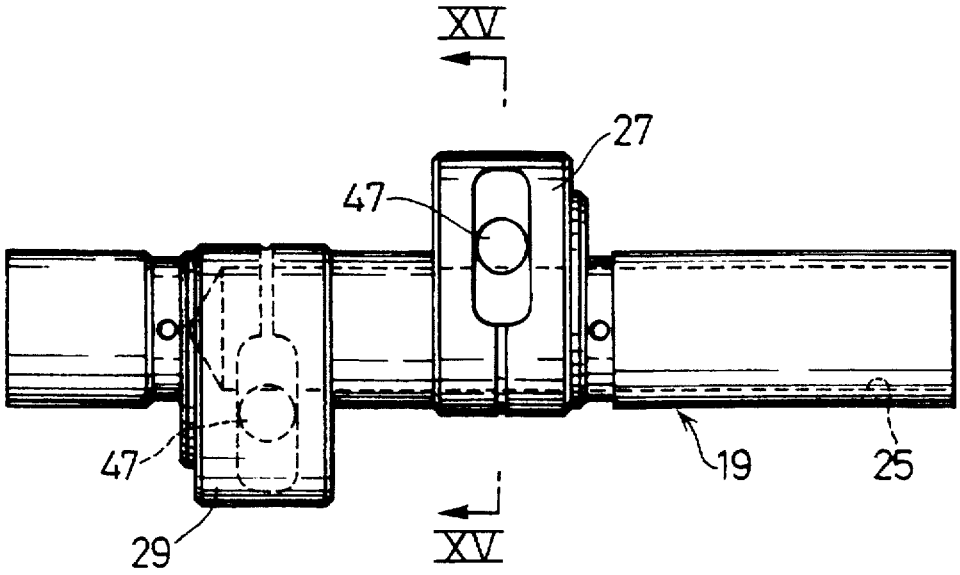
FIG. 14 is a plan view showing a shaft to be installed in the expander of FIG. 8.
Figure 15:
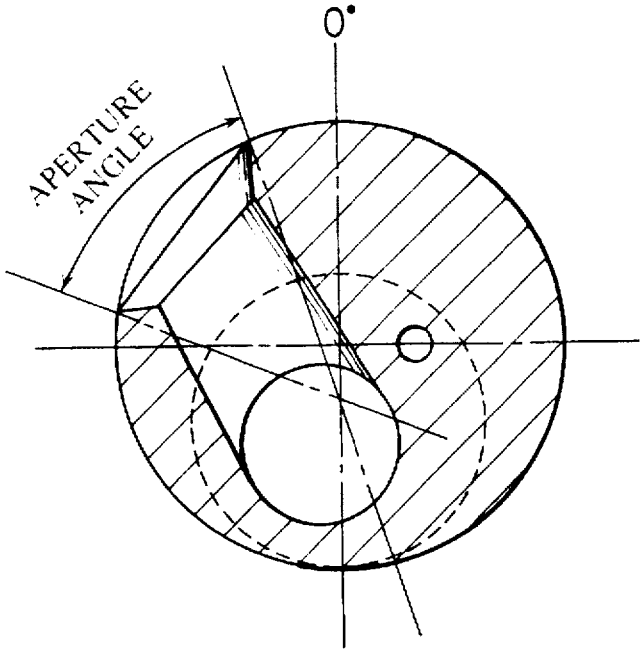
FIG. 15 is a section taken along a line G—G of FIG. 14.
Figure 16:
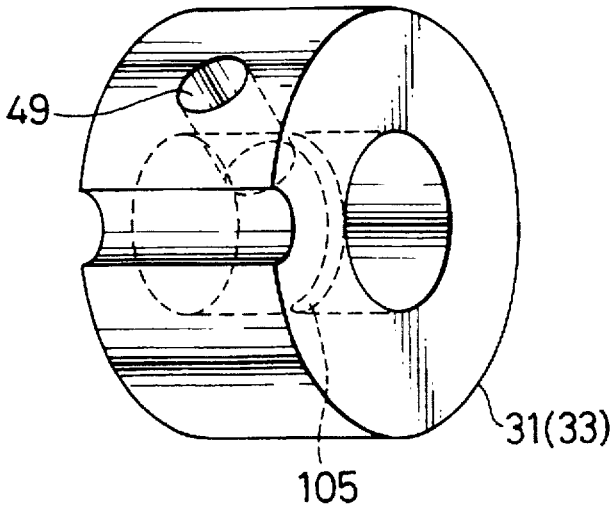
FIG. 16 is a perspective view showing a roller having a bypass along the inner wall thereof, the roller being arranged around each crank of the shaft of FIG. 14.

FIG. 14 is a plan view showing a shaft 19 that may be installed in the apparatus 200 of FIG. 8, and FIG. 15 is a section taken along a line G—G of FIG. 14. FIG. 16 is a perspective view showing a roller 31 (33) to be arranged around an eccentric part (crank) 27 (29) of the shaft 19. A bypass 105 is formed along the inner wall of each of the rollers 31 and 33.

The cranks 27 and 29 eccentrically rotate the rollers 31 and 33. The bypasses 105 of the rollers 31 and 33 are shifted from each other by 180 degrees. Each of the rollers 31 and 33 starts from an end of a port 49 and extends for about 180 degrees. Accordingly, one of the suction ports 47 of the cranks 27 and 29 is always communicating with the corresponding port 49 through the corresponding bypass 105 irrespective of the stopping positions of the suction ports 47.

(Bypasses 107 on bearings 21 and 23)

Figure 17:
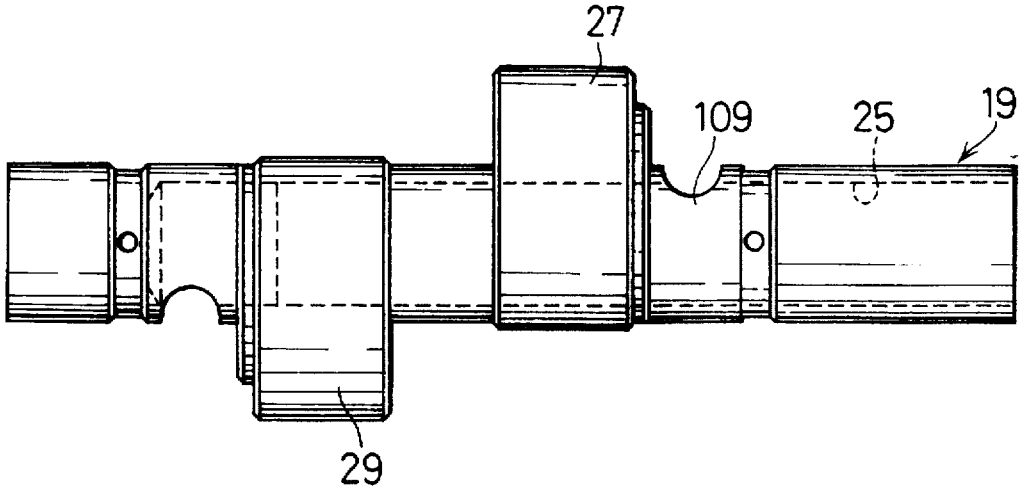
FIG. 17 is a plan view showing a shaft to be installed in the expander of FIG. 8.
Figure 18:
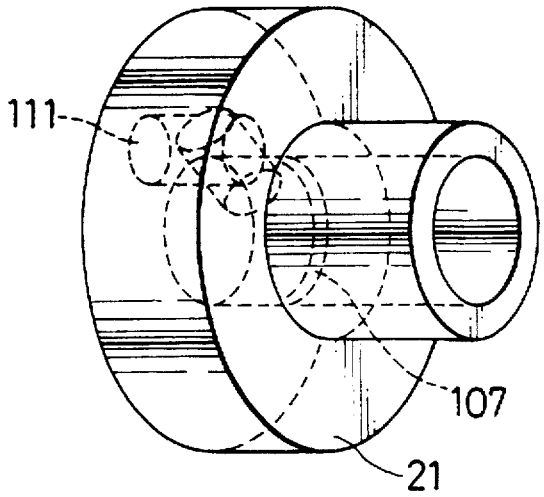
FIG. 18 shows a main-shaft bearing having a bypass, for supporting the shaft of FIG. 17.
Figure 19:
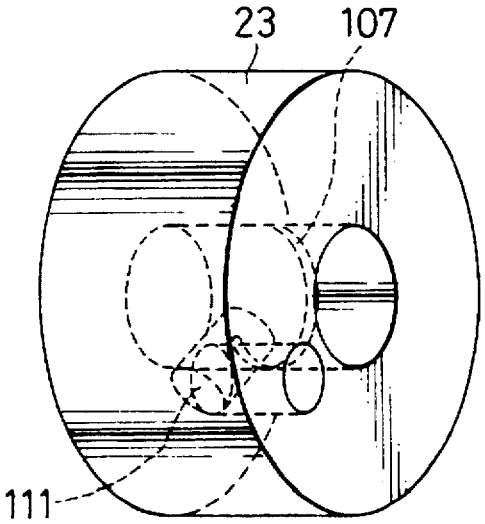
FIG. 19 shows a countershaft bearing having a bypass, for supporting the shaft of FIG. 17.

FIG. 17 is a plan view showing a shaft 19 that may be installed in the apparatus 200 of FIG. 8, FIG. 18 shows a main-shaft bearing 21 having a bypass 107, for supporting the shaft 19, and FIG. 19 shows a countershaft bearing 23 having a bypass 107, for supporting the shaft 19.

The bypasses 107 are formed along the inner walls of the bearings 21 and 23, respectively. The shaft 19 has ports 109 communicating with a suction path 25 axially formed in the shaft 19. The ports 109 also communicate with the bypasses 107 and ports 111 of the bearings 21 and 23. The ports 111 communicate with the expansion chambers 39.

The bypasses 107 of the bearings 21 and 23 are shifted from each other by 180 degrees, and each of the bypasses 107 starts from the corresponding port 111 and extends for about 180 degrees.

(Bypasses 107 on shaft 19)

Figure 20:
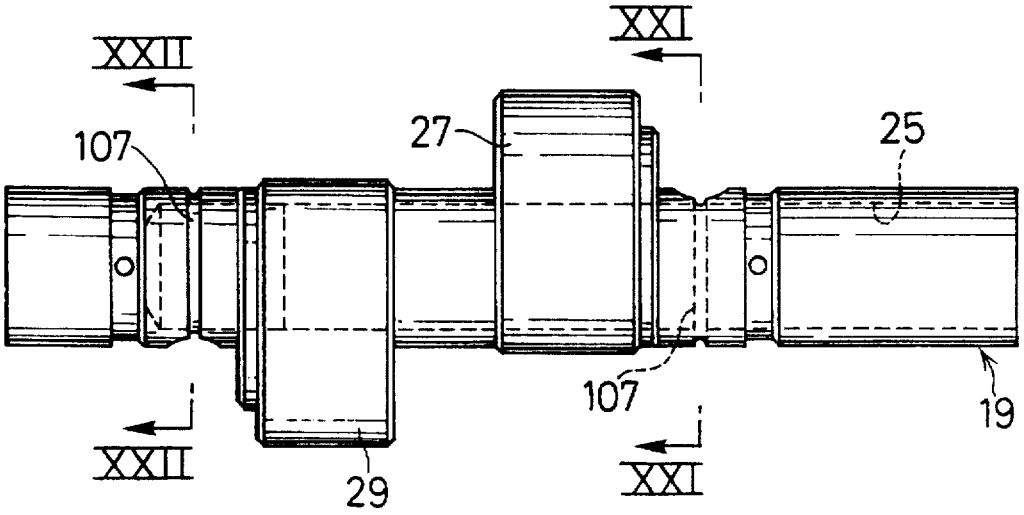
FIG. 20 is a plan view showing a shaft having bypasses and to be installed in the expander of FIG. 8.
Figure 21:
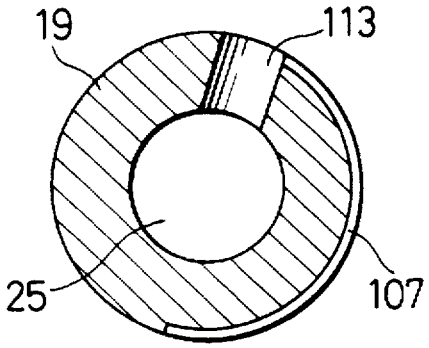
FIG. 21 is a section taken along a line H—H of FIG. 20.
Figure 22:
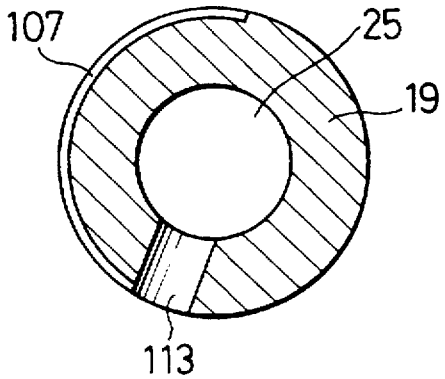
FIG. 22 is a section taken along a line I—I of FIG. 20.

FIG. 20 shows a shaft 19 having bypasses 107 and to be installed in the apparatus 200 of FIG. 8. FIG. 21 is a section taken along a line H—H of FIG. 20, and FIG. 22 is a section taken along a line I—I of FIG. 20.

The bypasses 107 of the shaft 19 are at the positions where the bearings 21 and 23 are arranged.

Each of the bypasses 107 communicates with a suction path 25, which is axially formed in the shaft 19, through a port 113 and with the expansion chamber 39 through the port 111 of a corresponding one of the bearings 21 and 23.

Returning to FIG. 8, the first cylinder 13 has a discharge port 55 opening to the bearing 21, and the second cylinder 15 has a discharge port 55 opening to the bearing 23.

More precisely, the discharge port 55 of the first cylinder 13 is open to a muffler chamber 57, which communicates with the discharge pipe 5 of the casing 7. The discharge port 55 of the second cylinder 15 is open to the muffler chamber 57 through a through hole **5*a*, which passes through the second cylinder 15, partition 17, and first cylinder 13. The muffler chamber 57 is open inside the casing 7 having the discharge pipe 5**.

The compressor 11 of FIG. 8 is identical to that of FIG. 1, and therefore, is not explained again.

Figure 24:
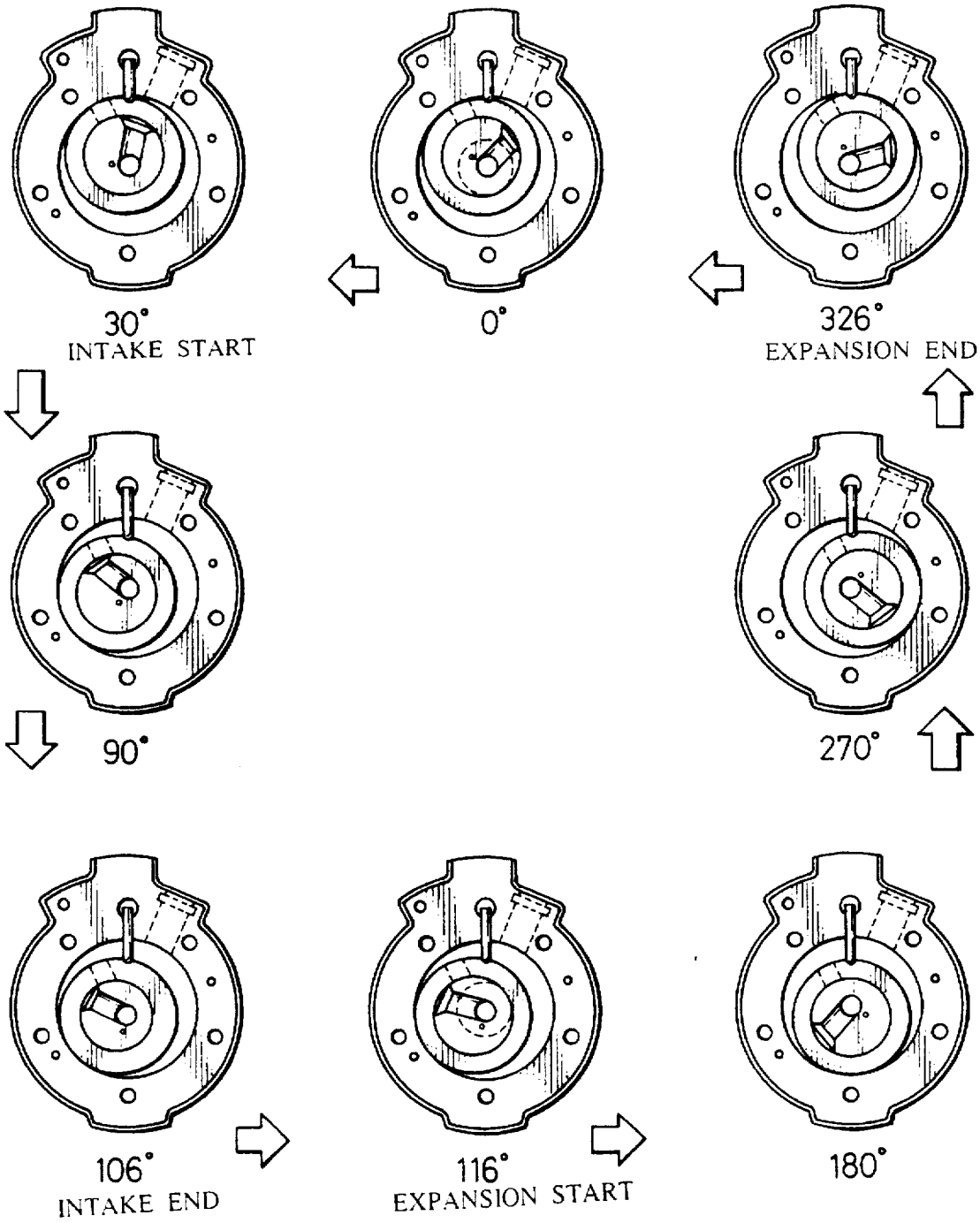
FIG. 24 shows a Rankine cycle of the expander of FIG. 8.

FIG. 23 shows the rotation angles and bypass opening timing of the expander 9 of the apparatus 200 of FIG. 8, and FIG. 24 shows a Rankine cycle of the apparatus 200.

The rollers 31 and 33 of the expander 9 are oscillated to draw high-pressure gas through the suction ports 47 and carry out suction, expansion, and discharge strokes. The gas is repeatedly drawn and discharged through the expander 9. This operation provides the shaft 19 with torque to drive the shaft 63 of the compressor 11. As a result, the roller 69 of the compressor 11 is eccentrically rotated to achieve the refrigerating cycle that compresses working gas, discharges it from the discharge pipe 5, and returns the gas to the suction pipe 70.

When the apparatus 200 is stopped, the suction ports 47 of the expander 9 are closed with respect to the ports 49. At this time, the bypasses secure communication between the suction path 25 and the expansion chambers 39.

As soon as the apparatus 200 is started, high-pressure gas is fed into one of the expansion chambers 39 through the corresponding bypass without a starting motor, to carry out the suction, expansion, and discharge strokes.

(Third embodiment)

Figure 25:
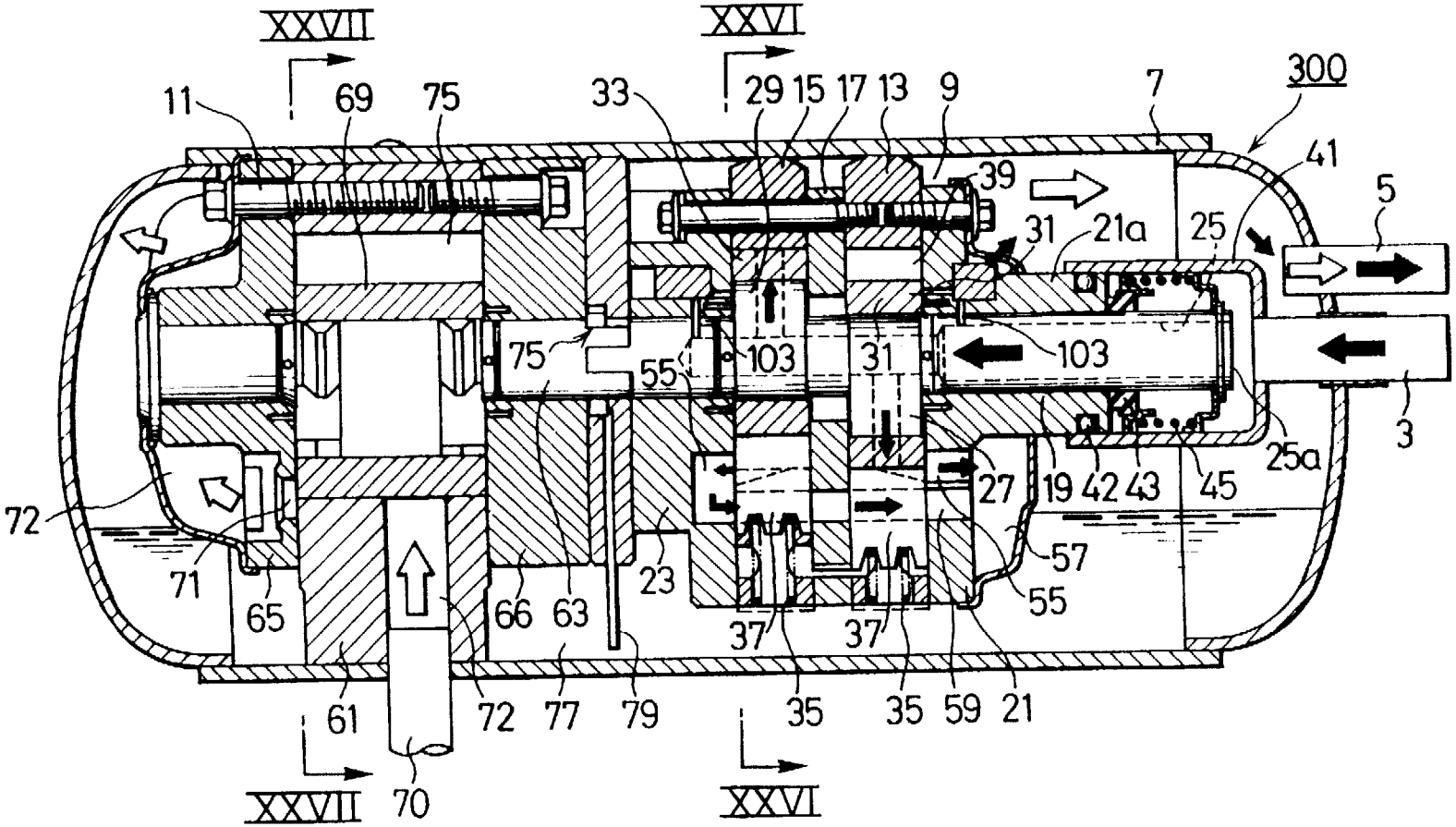
FIG. 25 is a longitudinal section showing a rolling-piston expander apparatus according to a third embodiment of the present invention, having a shutoff valve for opening and closing a bypass.
Figure 26:
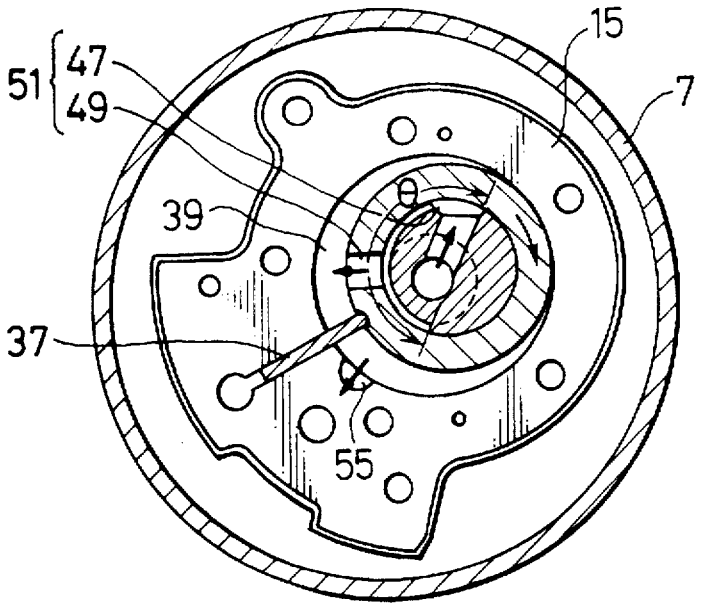
FIG. 26 is a section taken along a line J—J of FIG. 25.
Figure 27:
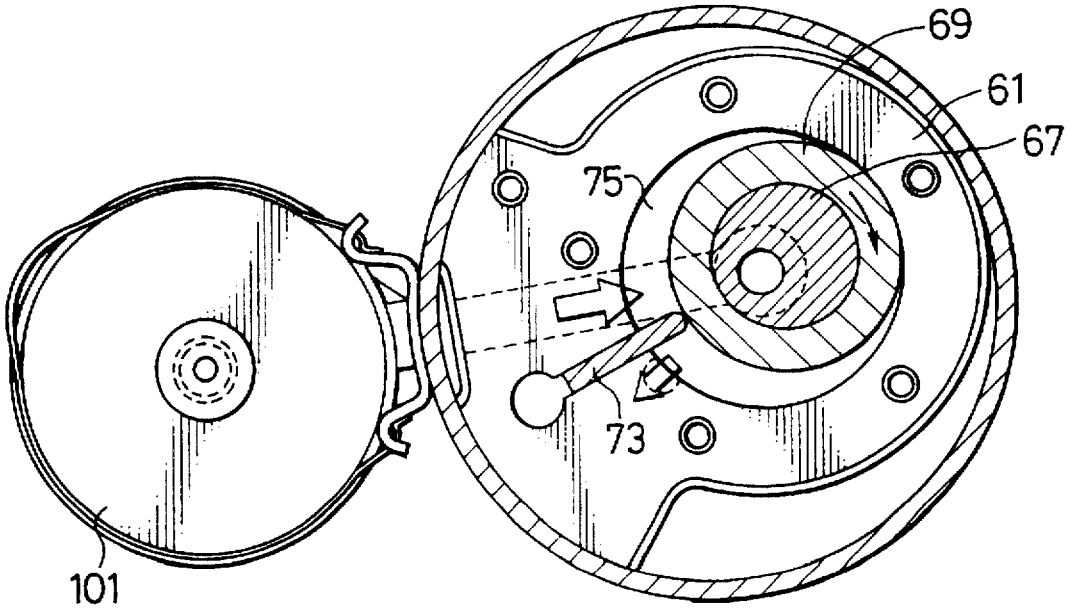
FIG. 27 is a section taken along a line K—K of FIG. 25.

FIG. 25 is a longitudinal section showing a rolling-piston expander apparatus 300 according to the third embodiment of the present invention, having a shutoff valve 117 for opening and closing a bypass 103. FIG. 26 is a section taken along a line J—J of FIG. 25, and FIG. 27 is a section taken along a line K—K of FIG. 25.

The bypasses 103 are formed in a main-shaft bearing 21 and a countershaft bearing 23, respectively. Each of the bypasses is closed a predetermined time after the start of the apparatus 300.

Each of the bypasses 103 communicates with a suction path 25, which is axially formed in a shaft 19, and with an expansion chamber 39.

Each of the bearings 21 and 23 has the shutoff valve 117 for opening and closing the corresponding bypass 103.

Figure 28:
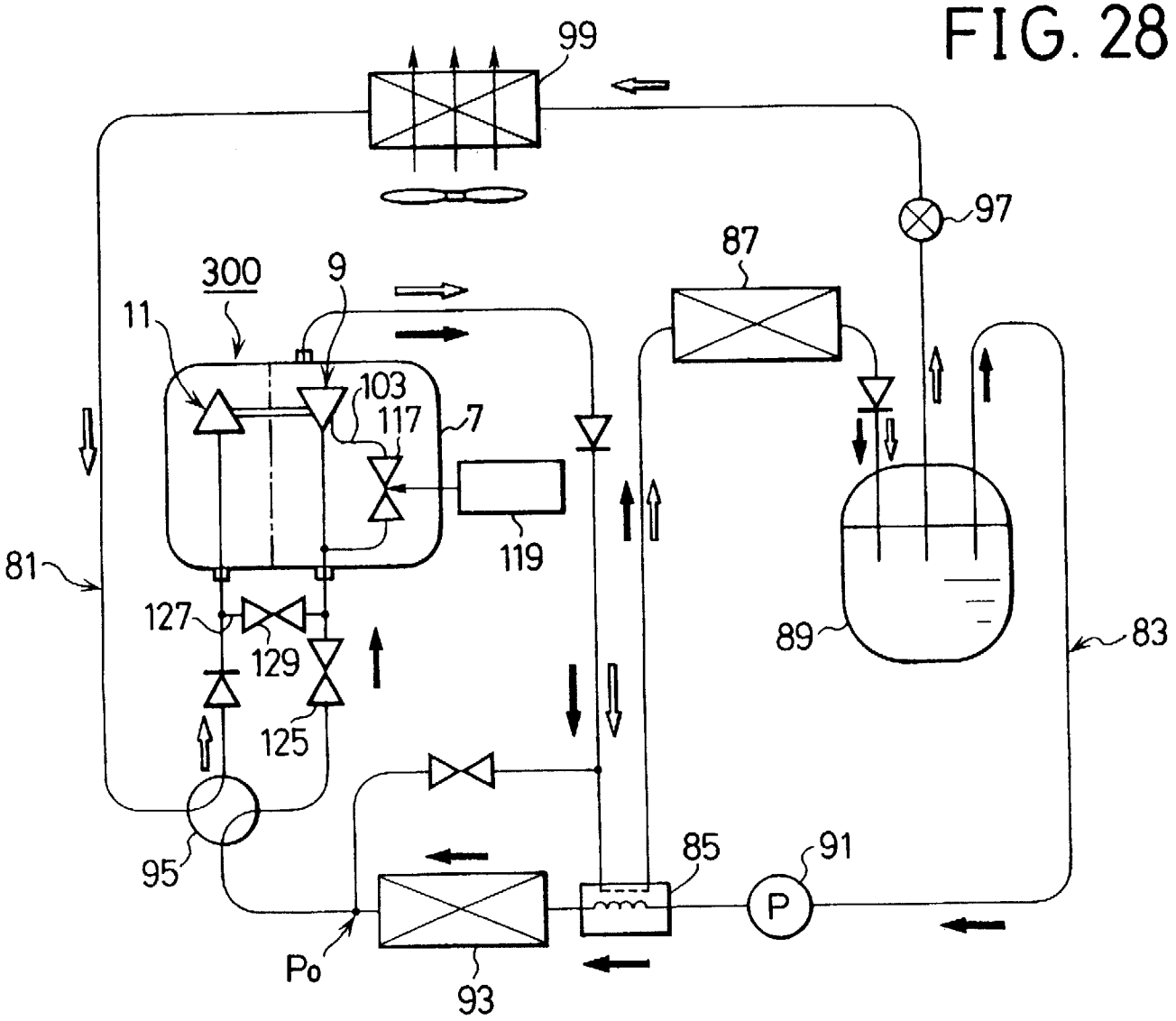
FIG. 28 shows a system of cycles of the apparatus of FIG. 25.

FIG. 28 shows cycles achieved by the apparatus 300 of FIG. 25.

Each shutoff valve 117 is controlled in response to a signal provided by a detector 119 for detecting the operation of the apparatus 300. The detector 119 closes the shutoff valves 117 in response to a signal from, for example, a temperature sensor for detecting the temperature of working gas, a pressure sensor for detecting the pressure of working gas, a speed sensor for detecting the revolution speed of an expander 9, or a pressure sensor for detecting the pressure of working gas in the expander 9 or a compressor 11.

Figure 29:
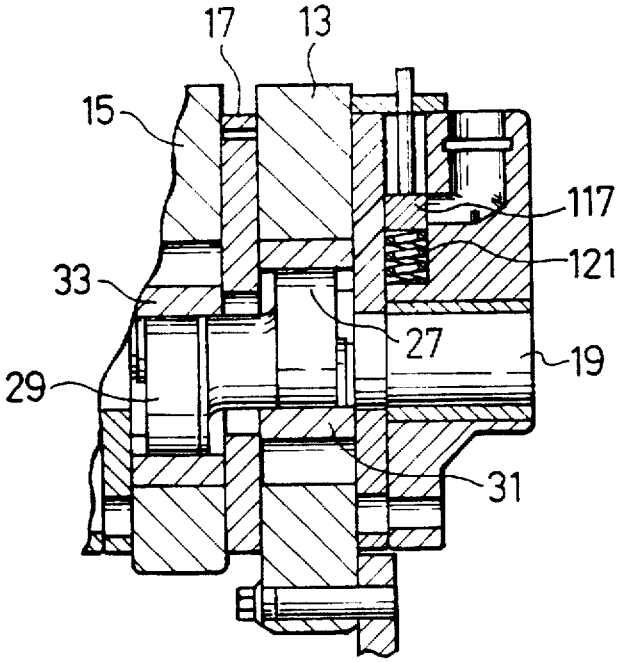
FIG. 29 is a section showing the shutoff valve of FIG. 25.
Figure 30:
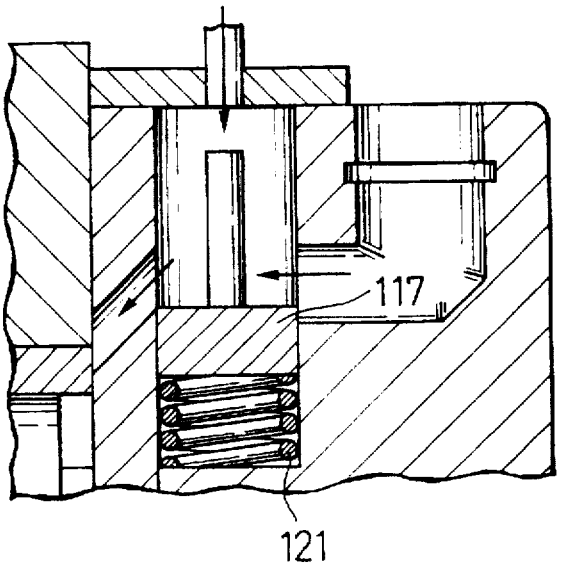
FIG. 30 is a section showing an opened state of the shutoff valve of FIG. 29.
Figure 31:
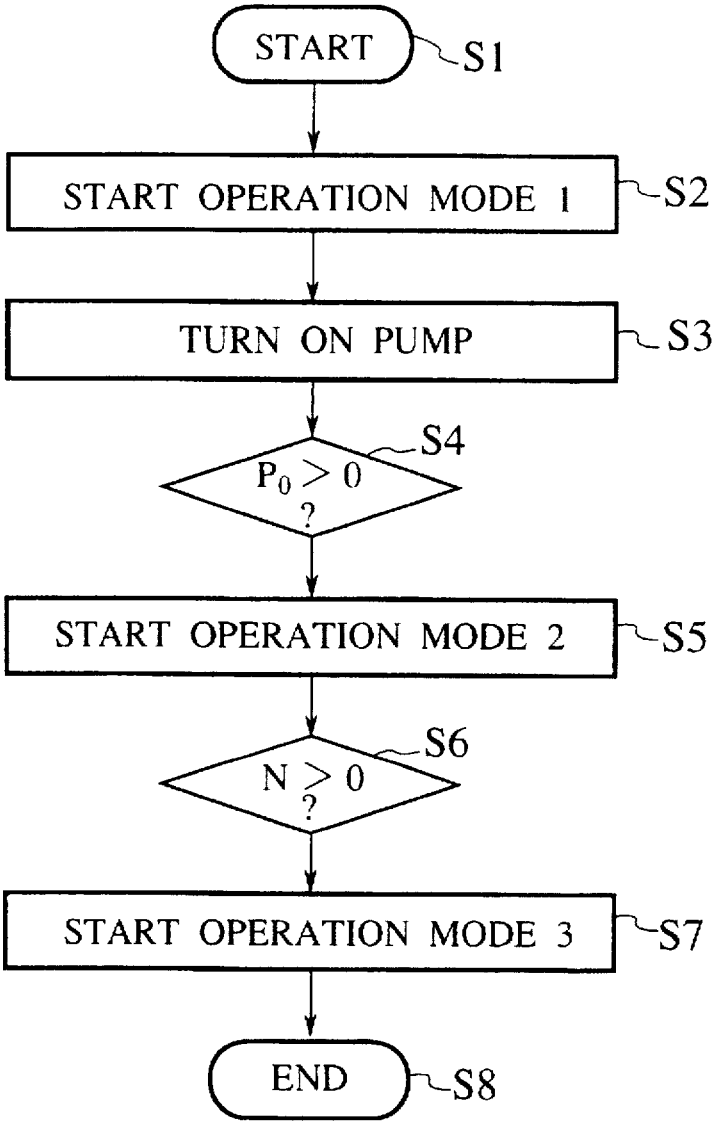
FIG. 31 is a flowchart showing the operation of the shutoff valve of FIG. 29.

FIG. 29 is a section showing the shutoff valve 117, FIG. 30 is a section showing an open state of the shutoff valve 117, and FIG. 31 is a flowchart showing the operation of the shutoff valve 117.

The shutoff valve 117 is provided with a spring 121 made of a shape-memory alloy that changes its shape depending on the temperature of working gas to be discharged from a discharge pipe 5. After a predetermined operation time, the temperature of working gas activates the spring 121 to push the shutoff valve 117 to close the bypass 103. The spring 121 may be made of bimetal that responds to a temperature change.

FIG. 28 shows cycles achieved by the apparatus 300 of FIG. 25 having the detector 119. The same parts as those of FIG. 7 are represented with like reference marks.

A hermetic casing 7 accommodates the compressor 11 and expander 9. The compressor 11 achieves a refrigerating cycle 81, and the expander 9 achieves a Rankine cycle 83.

In the Rankine cycle, the discharge pipe 5 of the casing 7 discharges working gas, which is passed through a heat recovery unit 85, a heat exchanger 87 such as a condenser, a liquid tank 89, a high-pressure pump 91, a heat recovery unit 85, an evaporator 93 with a heater, and a four-way valve 95 and is returned to a suction pipe 3 of the expander 9. The working gas is pressurized by the high-pressure pump 91 and is heated through the heat recovery unit 85 and evaporator 93. First and second shutoff valves 123 and 125 are arranged on the exit side of the evaporator 93, to return high-pressure gas to the heat recovery unit 85.

In the refrigerating cycle 81, the discharge pipe 5 of the casing 7 discharges working gas, which is passed through the heat recovery unit 85, the heat exchanger 87, the liquid tank 89, an expansion valve 97, a heat exchanger 99 such as an evaporator, the four-way valve 95, and an accumulator 101 and is returned to a suction pipe 70 of the compressor 11. The heat exchanger 99 cools air when the air passes through it. A third shutoff valve 129 is arranged in a path 127 to connect the refrigerating cycle to the Rankine cycle on the exit side of the four-way valve 95.

The operations of the shutoff valves 117, 123, 125, and 129 will be explained with reference to the flowchart of FIG. 31.

The apparatus 300 is started in step S1. Step S2 starts an operation mode 1. The operation mode 1 closes the shutoff valves 117, 125, and 129 and opens the shutoff valve 123. Step S3 turns on the high-pressure pump 91. Step S4 compares the output pressure Po of the evaporator 93 with a set pressure P.

If Po>P, step S5 starts an operation mode 2, which opens the shutoff valves 117 and 125 and closes the shutoff valves 123 and 129. As a result, high-pressure gas flows through the bypasses 103 into the expansion chambers 39, to carry out suction, expansion, and discharge strokes. The gas is repeatedly drawn and discharged through the expander. Step S6 checks the sensor for detecting the revolution speed N of the expander 9 and determines whether or not the speed N is equal to a set value. If it is equal to the set value, step S7 starts an operation mode 3, which closes the shutoff valves 117, 123, and 129 and opens the shutoff valve 125. This closes the bypasses 103 and starts a rated operation. Step S8 terminates the routine.

In this way, the third embodiment closes the bypasses 103 a predetermined time after the start of the apparatus 300, to stably operate the expander 9.

In summary, the present invention provides a rolling-piston expander apparatus capable of starting without a starting motor. The apparatus is compact, light, low-cost, and easy to assemble. The apparatus operates stably by closing bypasses after it has been started.

It should be apparent to those skilled in the art that many changes can be made in the details and arrangements of the steps and parts without departing from the scope of the invention as defined in the appended claims.

What is claimed is:

1. A rolling-piston expander apparatus comprising:

a cylinder disposed in a hermetic casing having a suction pipe and a discharge pipe;

a shaft eccentrically rotated;

a roller supported by said shaft in said cylinder so that said roller is oscillated and defining an expansion chamber communicating with a suction port and discharge port;

a suction timing controller for controlling the timing of the supply of gas into the expansion chamber; and gas supply means for supplying high-pressure gas into the expansion chamber when the suction timing is off.

2. A rolling-piston expander apparatus comprising:

cylinders incorporated in a hermetic casing having a suction pipe and a discharge pipe;

a shaft eccentrically rotated;

rollers supported by said shaft in said cylinder so that said rollers are oscillated and defining an expansion chamber communicating with a suction port and discharge port;

a suction timing controller for controlling the timing of the supply of gas into the expansion chambers; and gas supply means for supplying high-pressure gas into one of the expansion chambers when the suction timing is off.

3. The apparatus of claim 2, wherein said gas supply means involves apertures for the expansion chambers, the apertures being shifted from each other by at least 180 degrees.

4. The apparatus of claim 1, wherein said gas supply means involves a bypass for guiding high-pressure gas into the expansion chamber when the suction timing is off.

5. The apparatus of claim 2, wherein said gas supply means involves bypasses for guiding high-pressure gas into the expansion chambers when the suction timing is off.

6. The apparatus of claim 4, wherein the bypass is formed along the periphery of an eccentric part of said shaft for eccentrically driving said roller.

7. The apparatus of claim 4, wherein the bypass is formed along the inner wall of said roller.

8. The apparatus of claim 4, wherein the bypass is formed along the periphery of said shaft.

9. The apparatus of claim 4, wherein the bypass is formed along the periphery of a bearing that rotatably supports said shaft.

10. The apparatus of claim 4, further comprising means for opening and closing the bypass.

11. The apparatus of claim 5, further comprising means for opening and closing the bypasses.

12. The apparatus of claim 10, further comprising means for detecting the operation state of the apparatus and providing a closing signal to the opening and closing means to close the bypass.

13. The apparatus of claim 11, further comprising means for detecting the operation state of the apparatus and providing a closing signal to the opening and closing means to close the bypasses.

14. The apparatus of claim 12, wherein the detecting means provides the closing signal according to a signal from a temperature sensor for detecting the temperature of working gas.

15. The apparatus of claim 12, wherein the detecting means provides the closing signal according to a signal from a pressure sensor for detecting the pressure of working gas.

16. The apparatus of claim 12, wherein the detecting means provides the closing signal according to a signal from a sensor for detecting the rotation speed of the apparatus.

17. The apparatus of claim 12, wherein the detecting means provides the closing signal according to a signal from a pressure sensor for detecting the pressure of working gas in the apparatus.

18. The apparatus of claim 10, wherein the opening and closing means is a spring made of a shape-memory alloy whose shape changes depending on the temperature of working gas.

19. The apparatus of claim 11, wherein the opening and closing means is a spring made of a shape-memory alloy whose shape changes depending on the temperature of working gas.

* * * * *

UNITED STATES PATENT AND TRADEMARK OFFICE

CERTIFICATE OF CORRECTION

PATENT NO. : 5,775,883

DATED : July 7, 1998

INVENTOR(S) : Hitoshi HATTORI et al.

It is certified that error appears in the above-identified patent and that said Letters Patent is hereby corrected as shown below:

On the title page, insert the following item:

--[30] Foreign Application Priority Data

August 14, 1995 [JP] Japan 7-207191--

Signed and Sealed this

Eighteenth Day of January, 2000

*Attest:*

Q. TODD DICKINSON

*Attesting Officer*

*Commissioner of Patents and Trademarks*